US011703277B2

(12) United States Patent
Odell et al.

(10) Patent No.: US 11,703,277 B2
(45) Date of Patent: Jul. 18, 2023

(54) SYSTEMS AND METHODS FOR NATURAL GAS COOLING

(71) Applicant: Cosmodyne, LLC, Seal Beach, CA (US)

(72) Inventors: John Jefferson Odell, Irvine, CA (US); Irina Dean, Rolling Hills Estate, CA (US)

(73) Assignee: COSMODYNE, LLC, Seal Beach, FL (US)

( * ) Notice: Subject to any disclaimer, the term of this patent is extended or adjusted under 35 U.S.C. 154(b) by 430 days.

(21) Appl. No.: 16/783,896

(22) Filed: Feb. 6, 2020

(65) Prior Publication Data

US 2021/0247135 A1 Aug. 12, 2021

(51) Int. Cl.
*F25J 1/02* (2006.01)
*F25J 1/00* (2006.01)

(52) U.S. Cl.
CPC ..... *F25J 1/0052* (2013.01); *F25J 1/0015* (2013.01); *F25J 1/0022* (2013.01); *F25J 1/0072* (2013.01); *F25J 2245/42* (2013.01)

(58) Field of Classification Search
None
See application file for complete search history.

(56) References Cited

U.S. PATENT DOCUMENTS

2009/0217701 A1* 9/2009 Minta ..... F25J 1/0288 62/612
2012/0060553 A1* 3/2012 Bauer ..... F25J 1/0072 62/614

* cited by examiner

*Primary Examiner* — Brian M King
(74) *Attorney, Agent, or Firm* — Shook, Hardy & Bacon, L.L.P.

(57) ABSTRACT

A system for natural gas cooling using nitrogen. The system can include a nitrogen liquefier and a natural gas cooler. The nitrogen liquefier can provide liquid nitrogen to the natural gas cooler. One or more heat exchangers of the natural gas cooler can include a gaseous nitrogen output that is in fluid communication with the nitrogen liquefier. In response to receiving gaseous nitrogen at the nitrogen liquefier, from the one or more heat exchangers, a production rate of the the nitrogen liquefier is adjusted.

11 Claims, 6 Drawing Sheets

SYSTEMS AND METHODS FOR NATURAL GAS COOLING

TECHNICAL FIELD

The present disclosure relates to cooling natural gas. More particularly, the present disclosure relates to systems and methods for cooling natural gas using nitrogen.

BACKGROUND

Conventional processes for cooling natural gas, e.g., natural gas liquefaction, can include compressing a natural gas stream and/or exposing the natural gas stream to one or more refrigerants. However, compressing natural gas in certain conventional liquefaction processes is a resource-intensive process. Further, the same or other conventional natural gas liquefaction systems may utilize various refrigerants that may be slow to react to a heat load in the liquefaction process, thereby decreasing the efficiency of such processes.

BRIEF DESCRIPTION OF THE DRAWINGS

Illustrative aspects are described in detail below with reference to the attached drawing figures, which are incorporated by reference herein and wherein.

DESCRIPTION

Figure 1:
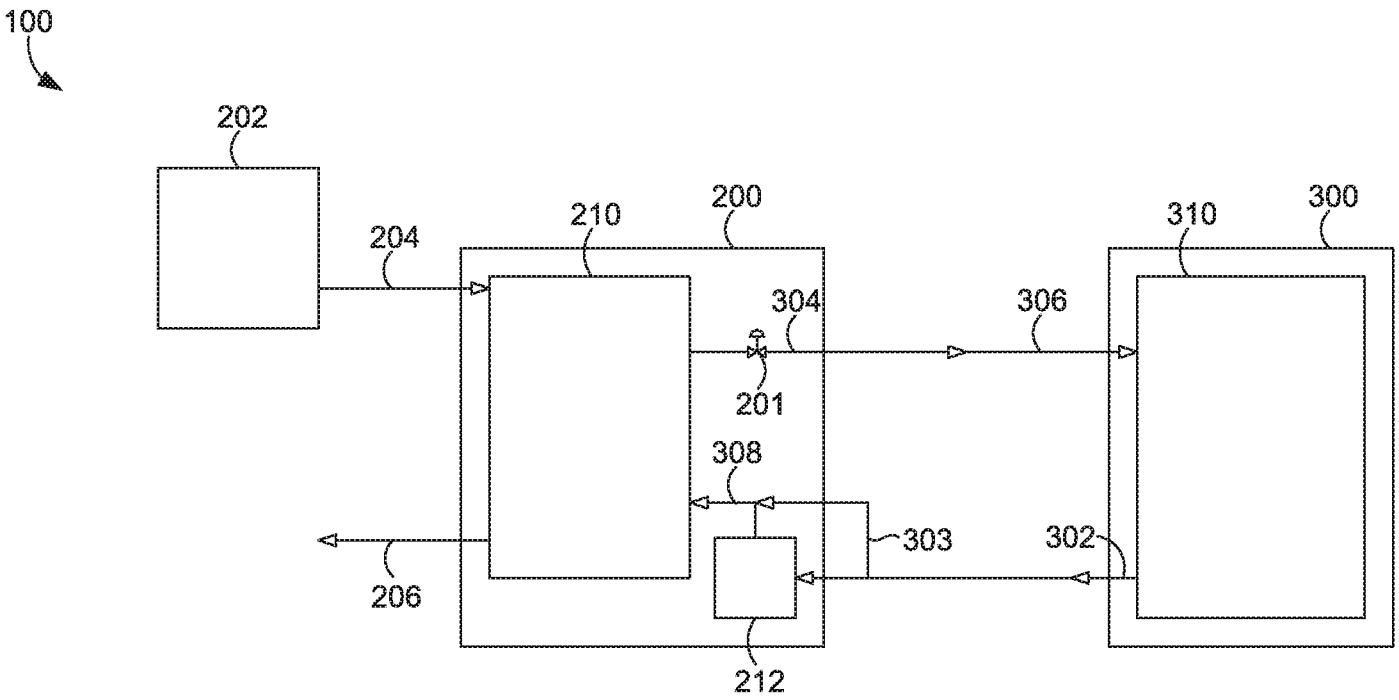
FIG. 1 depicts one example system for cooling natural gas that includes a natural gas cooler and a nitrogen liquefier, in accordance with aspects hereof.

Aspects herein relate to systems and processes for cooling natural gas. In certain aspects, systems described herein can be utilized for natural gas liquefaction.

Certain conventional natural gas liquefaction processes can include compressing natural gas. However as noted above, compressing natural gas in such processes is resource-intensive and inefficient. Further, in the same or other conventional processes, a refrigerant may be utilized to aid in liquefying the natural gas. Yet, such processes may be slow to react to total heat load requirements in the liquefaction system, which can introduce inefficiencies into the system. Therefore, there is a need for new systems and processes for cooling natural gas that are less resource-intensive and/or more efficient.

The systems and processes described herein can alleviate one or more of the issues described above. For instance, in aspects, the natural gas cooling systems described herein can be coupled to a nitrogen liquefier such that in response to a change in production rate and/or production amount of cooled natural gas from a natural gas cooler, the production rate or amount of the nitrogen liquefier can be changed. In such aspects, one or more gaseous nitrogen input conduits of the nitrogen liquefier can be in fluid communication with one or more heat exchangers of the natural gas cooler so that gaseous nitrogen produced or exiting from the one or more heat exchangers is provided to the nitrogen liquefier. This newly provided gaseous nitrogen can, in aspects, affect the production of the nitrogen liquefier. In certain aspects, the additional gaseous nitrogen provided to the nitrogen liquefier from the one or more heat exchangers of the natural gas cooler can affect the suction pressure of one or more compressors associated with the nitrogen liquefier, and in response, the one or more compressors can automatically respond, e.g., by increasing or decreasing its suction pressure, to this newly added gaseous nitrogen in its system. In aspects, such responsive actions of the nitrogen liquefier, e.g., via the one or more compressors, can allow for the natural gas cooler and coupled nitrogen liquefier to automatically adjust for a change in the total heat load, thereby resulting in a more efficient natural gas cooling system and process.

Additionally or alternately, in certain aspects, the natural gas cooler described herein can utilize liquid nitrogen, e.g., in combination with one or more heat exchangers, to cool the natural gas. In certain aspects, such systems may not include compressing the natural gas and can therefore provide a natural gas cooling system that is less resource intensive than certain other conventional systems and processes.

Accordingly, in one aspect, a system for natural gas cooling using nitrogen is provided. The system can include a nitrogen liquefier, the nitrogen liquefier including one or more gaseous nitrogen input conduits in fluid communication with one or more gaseous nitrogen sources; one or more liquid nitrogen output conduits; and one or more compressors in fluid communication with the one or more gaseous nitrogen input conduits. The nitrogen liquefier can be adapted to convert gaseous nitrogen supplied by the one or more gaseous nitrogen sources into liquid nitrogen that is provided to the one or more liquid nitrogen output conduits. The system can further include a natural gas cooler, the natural gas cooler including: one or more natural gas input conduits in fluid communication with one or more natural gas sources; one or more cooled liquid natural gas output conduits; and one or more heat exchangers in fluid communication with: i) the one or more gaseous nitrogen input conduits of the nitrogen liquefier; and ii) the one or more cooled liquid natural gas output conduits. The natural gas cooler can be adapted to reduce a temperature of natural gas from the one or more natural gas sources forming a cooled liquid natural gas that is provided to the one or more cooled liquid natural gas output conduits. The system can be configured such that, in response to a change in a production rate of cooled liquid natural gas being produced in the one or more heat exchangers, a production rate of liquid nitrogen produced in the nitrogen liquefier is changed.

In another aspect, a method for cooling natural gas using nitrogen is provided. The method can include receiving a first volume of natural gas from one or more natural gas sources; and receiving a first volume of liquid nitrogen from a nitrogen liquefier. The method can also include exposing the first volume of natural gas to one or more heat exchangers having at least a portion of the first volume of liquid nitrogen present therein to reduce a temperature of the first volume of natural gas and to form a first volume of gaseous nitrogen, where the one or more heat exchangers is in fluid communication with the nitrogen liquefier. Additionally, the method can include receiving, at the nitrogen liquefier, the first volume of gaseous nitrogen from the one or more heat exchangers. The method can also include, in response to the receiving, at the nitrogen liquefier, the first volume of gaseous nitrogen from the one or more heat exchangers, adjusting a liquid nitrogen output level of the nitrogen liquefier.

As discussed above, aspects herein relate to systems and processes for cooling natural gas. In certain aspects, systems described herein can be utilized for natural gas liquefaction. In certain aspects, the systems disclosed herein can include a nitrogen liquefier and a natural gas cooler, where the nitrogen liquefier can provide liquid nitrogen to the natural gas cooler. In various aspects, one or more heat exchangers of the natural gas cooler can utilize the liquid nitrogen to cool at least a portion of the natural gas, and can output at least gaseous nitrogen via one or more gaseous nitrogen conduits that are in fluid communication with the nitrogen liquefier. In such aspects, at least a portion of this gaseous nitrogen can be provided to the nitrogen liquefier, where in response, the liquid nitrogen production rate or production amount from the nitrogen liquefier can be altered. In certain aspects, in response to gaseous nitrogen being supplied to the nitrogen liquefier from the natural gas cooler, the nitrogen liquefier may automatically adjust its liquid nitrogen production rate or production amount, e.g., due to a change in suction pressure of the one or more compressors in the nitrogen liquefier.

As used herein, the term "about" means within 10% of the numerical value of the number with which it is being used unless otherwise indicated or custom in the art dictates otherwise.

FIG. 1 schematically depicts one example system 100 for cooling natural gas using nitrogen. It should be understood that the system 100 depicted in FIG. 1 is provided schematically to highlight the connections between various components of the system 100. It should also be understood that the system 100 depicted in FIG. 1 is but one example system and that other systems for cooling natural gas using nitrogen are also contemplated by the disclosure herein. In the aspect depicted in FIG. 1, the system 100 can include a natural gas cooler 200 and a nitrogen liquefier 300. In the aspect depicted in FIG. 1, the natural gas cooler 200 can be in fluid communication with one or more natural gas sources 202, e.g., via a natural gas input conduit 204.

In aspects, the one or more natural gas sources 202 can include any convenient source of natural gas that is desirable to expose to a cooling process. In one aspect, the one or more natural gas sources 202 can include boil-off gas from a liquid natural gas storage tank or from a non-tank source whether land- or sea-based. As used herein, boil-off gas can refer to the vapor generated from a liquid natural gas source being exposed to heat or other conditions, in aspects. In one or more aspects, the one or more natural gas sources 202 can include a liquid, gas, or a combination thereof.

In various aspects, the one or more sources of natural gas 202 can have a methane content of between about 51 mol. % and about 100 mol. %, between about 51 mol. % and about 98 mol. %, or between about 70 mol. % and about 95 mol. %, or a methane content of about 51 mol. % or more, about 70 mol. % or more, or about 90 mol. % or more. In the same or alternative aspects, the one or more sources of natural gas 202 can optionally include nitrogen in an amount between about 0.1 mol. % and about 30 mol. %, between about 0.1 mol. % and about 25 mol. %, or between about 0.1 mol. % and about 20 mol. %; or about 10 mol. % or less, or about 10 mol. % or more. In various aspects, the one or more sources of natural gas 202 may not include carbon dioxide, or may include less than 50 mol, ppm carbon dioxide, or less than 2 mol. % carbon dioxide.

In various aspects, the one or more natural gas sources 202 can be at a pressure of between 0.2 pounds per square inch absolute (psia) and about 200 psia, or between about 0.3 psia and about 175 psia, or between about 0.4 psia and about 160 psia; or between about atmospheric pressure, e.g., 14.7 psia and about 200 psia, between about 14.7 psia and about 175 psia, or between about 14.7 psia and about 160 psia.

In one aspect, prior to or upon entry to the natural gas cooler 200, the one or more sources of natural gas 202 can have any temperature, and such a temperature may depend upon whether the one or more sources of natural gas 202 is in liquid form, gaseous form, or a combination thereof. In certain aspects, prior to or upon entry to the natural gas cooler 200, the one or more sources of natural gas 202 can have a temperature in the range of between about −50° F. and about −270° F., or between about −70° F. and −270° F. In one aspect, when the one or more natural gas sources 202 includes warm liquid natural gas, the one or more natural gas sources 202 can have a temperature in the range of about −255° F. to about −270° F., or a temperature of about −265° F. In certain aspects, when the one or more natural gas sources 202 includes boil-off gas and/or natural gas in gaseous form, the one or more natural gas sources 202 can have a temperature in the range of about −50° F. to about −150° F., or about −70° F. to about −140° F., or about −100° F.

In certain aspects as discussed above, the natural gas cooler 200 can reduce a temperature of at least a portion of the one or more natural gas sources 202 provided to the natural gas cooler 200. In the same or alternate aspects, at least a portion of the one or more natural gas sources 202 can undergo a phase change, e.g., from a gas to a liquid, in the natural gas cooler 200. In one aspect, the one or more natural gas sources 202 may not undergo a phase change by exposure to the natural gas cooler 200, but may reduce the temperature of the one or more natural gas sources 202, e.g., by converting a warm liquid natural gas to a cool liquid natural gas.

In certain aspects as discussed above, the natural gas cooler 200 can include one or more heat exchangers, e.g., the heat exchanger 210, depicted in FIG. 1. The heat exchanger 210 can be any convenient type of heat exchanger as long as such a heat exchanger is compatible with natural gas cooling using nitrogen, e.g., liquid nitrogen. In operation, in certain aspects, the heat exchanger 210 is adapted to transfer heat from the natural gas to the liquid nitrogen, thereby cooling the natural gas while also warming up the liquid nitrogen and, in aspects, forming gaseous nitrogen. Further in such aspects, the gaseous nitrogen formed from the liquid nitrogen in the heat exchange 210, can be provided to the nitrogen liquefier 300 discussed further below, while the cooled liquid natural gas can exit the heat exchanger 210 and/or the natural gas cooler 200, e.g., via the cooled liquid natural gas conduit 206.

In aspects, the heat exchanger 210 of the natural gas cooler 200 can be in fluid communication with the one or more natural gas sources 202 via the natural gas input conduit 204. In various aspects, the heat exchanger 210 of the natural gas cooler 200 can be in fluid communication with one or more liquid nitrogen output conduits, e.g., the liquid nitrogen output conduit 302, which may ultimately supply liquid nitrogen to the heat exchanger 210. In aspects, the natural gas cooler 200 can include a liquid nitrogen storage vessel 212 that may store liquid nitrogen, e.g., from the nitrogen liquefier or other source, for use in the heat exchanger 210. In such aspects, the liquid nitrogen storage vessel 212 can be in fluid communication with the liquid nitrogen output conduit 302 of the nitrogen liquefier 300 and in fluid communication with the heat exchanger 210, e.g., via the liquid nitrogen input conduit 308. In an alternative aspect, liquid nitrogen may be supplied to the heat exchanger 210 without first being provided to the liquid nitrogen storage vessel 212, e.g., via conduit 303.

In certain aspects as discussed above, a heat exchanger associated with a natural gas cooler, e.g., the heat exchanger 210, can be in fluid communication with one or more gaseous nitrogen input conduits of the nitrogen liquefier 300. For example, in the aspect depicted in FIG. 1, the heat exchanger 210 can be coupled to a gaseous nitrogen output conduit 304 in fluid communication with one or more gaseous nitrogen input conduits 306, for providing the gaseous nitrogen from the heat exchanger 210 to the nitrogen liquefier 300. In aspects, as discussed further below, the nitrogen liquefier 300 can liquefy the gaseous nitrogen, which may then be utilized in any desired process, including for use in the natural gas cooler 200.

Figure 2:
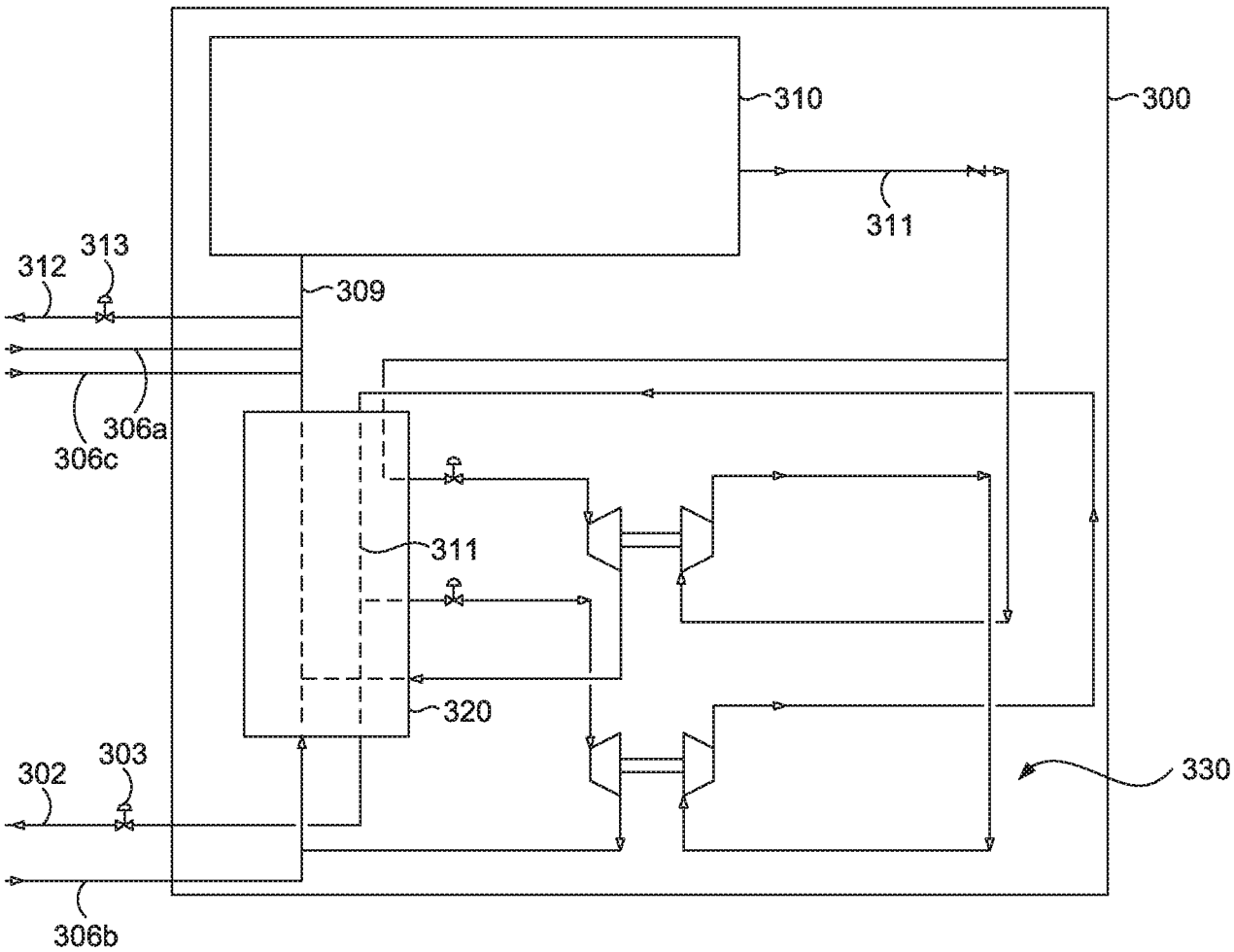
FIG. 2 depicts one example nitrogen liquefier, in accordance with aspects hereof.

FIG. 2 provides a schematic depiction of an example nitrogen liquefier 300 for use in the systems and processes disclosed herein. In aspects, the nitrogen liquefiers that can be utilized in the systems described herein can be of any convenient design, as long as such a nitrogen liquefier includes the features discussed above with respect to FIG. 1. In aspects, the nitrogen liquefier 300 can perform a reverse Brayton cycle process for liquefying nitrogen.

In the aspect depicted in FIG. 2, the nitrogen liquefier 300 can include one or more compressors 310 that receive one or more streams of nitrogen for liquefying as described herein. The one or more compressors 310 can be any convenient compressors that may be utilized to liquefy nitrogen. In aspects, the one more compressors 310 can receive one or more streams of nitrogen via the compressor input conduit 309. In such aspects, the gaseous nitrogen discussed above can be provided to the compressor input conduit 309. For instance, the one or more gaseous nitrogen input conduits 306 described above with respect to FIG. 1 can include a warm gaseous nitrogen input conduit 306*a* and a cool gaseous nitrogen input conduit 306*b*, where each of the conduits 306*a* and 306*b* are in fluid communication with the compressor input conduit 309. In aspects, another gaseous nitrogen input conduit, e.g., the nitrogen recovery compressor input conduit 306*c*, can be present and in fluid communication with the compressor input conduit 309. The nitrogen recovery compressor input conduit 306*c* is discussed further below with respect to example systems in FIG. 5.

In aspects, the warm gaseous nitrogen input conduit 306*a* can be adapted to provide gaseous nitrogen to the compressor input conduit 309, where the gaseous nitrogen is at a temperature of between about −30° F. to about 130° F. or between about −20° F. to about 100° F. In the same or alternative aspects, the warm gaseous nitrogen input conduit 306*a* can be adapted to provide gaseous nitrogen to the compressor input conduit 309, where the gaseous nitrogen is at a pressure of between about 50 psia to about 170 psia, or between about 60 psia to about 140 psia.

In aspects, the cool gaseous nitrogen input conduit 306*b* can be adapted to provide gaseous nitrogen to the compressor input conduit 309, where the gaseous nitrogen is at a temperature of between about −150 CF to about −300° F., or between about −200° F. to about −290° F. In the same or alternative aspects, the cool gaseous nitrogen input conduit 306*b* can be adapted to provide gaseous nitrogen to the compressor input conduit 309, where the gaseous nitrogen is at a pressure of between about 50 psia to about 170 psia, or between about 60 psia to about 140 psia.

In various aspects, at least a portion of the nitrogen exiting the one or more compressors 310, via the compressor output conduit 311, can enter a recirculation loop 330 that may include one or more expanders or boosters, to further cool the nitrogen. In the same or alternative aspects, the nitrogen exiting the one or more compressors 310, via the compressor output conduit 311, and/or exiting the recirculation loop 330, can be exposed to a heat exchanger 320, where cool gaseous nitrogen provided by the cool gaseous nitrogen conduit 306*b* may be utilized to further cool the nitrogen in the compressor output conduit 311 prior to exiting the nitrogen liquefier 300 via the liquid nitrogen output conduit 302. In aspects, the liquid nitrogen output conduit 302 can be coupled to a valve 303 to close the liquid nitrogen output conduit 302 as needed.

The nitrogen liquefier 300 can optionally include a nitrogen vent line 312 and associated valve 313 in fluid communication with the compressor input conduit 309 in order vent a portion of the nitrogen in the compressor input conduit 309, as needed for operation of the nitrogen liquefier 300.

As discussed above in certain aspects, such as that depicted in FIG. 1, in response to gaseous nitrogen that was boiled off in the heat exchanger 210 and supplied to the nitrogen liquefier 300, the nitrogen liquefier 300 may automatically adjust its liquid nitrogen production rate or production amount. In aspects, such automatic adjustment of the liquid nitrogen production rate or production amount may be due to the change in suction pressure of the one or more compressors in the nitrogen liquefier 300, which may be caused by the introduction of the gaseous nitrogen from the natural gas cooler 200. In such aspects, an operator does not need to control the suction pressure of the one or more compressors 310; rather, the suction pressure of the one or more compressors 310 can spontaneously rise in response to an increase in pressure in the circulating nitrogen in the nitrogen liquefier 300. Stated differently, when gaseous nitrogen is provided to the nitrogen liquefier 300 in an amount or flow that is higher than the amount or flow of liquid nitrogen currently being produced by the nitrogen liquefier 300 at that current pressure, the compressor suction pressure in the nitrogen liquefier 300 will increase on its own, e.g., due to more nitrogen being added to the system than being taken out and since the volumetric flow rate within the nitrogen liquefier 300 is maintained at substantially a constant rate.

In the same or alternative aspects, when the natural gas cooler 200 has less load, e.g., produces less cooled liquid natural gas and/or when less gaseous nitrogen exits the natural gas cooler 200 and is provided to the nitrogen liquefier 300, the suction pressure in the one or more compressors 310 will ultimately fall. For instance in such aspects, when less gaseous nitrogen is being provided to the nitrogen liquefier 300 in an amount or flow that is less than the amount or flow of liquid nitrogen currently being produced by the nitrogen liquefier 300 at that current pressure, then the compressor suction pressure in the nitrogen liquefier 300 will decrease on its own, e.g., due to less nitrogen being added to the system than being taken out and since the volumetric flow rate within the nitrogen liquefier 300 is maintained at substantially a constant rate.

In aspects, for every unit of natural gas that is cooled in the natural gas cooler 200, three to five units of liquid nitrogen can be produced in the nitrogen liquefier 300. In such aspects, the nitrogen liquefier 300, in order to produce the three to five units of liquid nitrogen, will circulate approximately 15-25 units of nitrogen within the nitrogen liquefier 300, e.g., circulate 1l nitrogen within one or more of the recirculation loop 330, the heat exchanger 320, and the one or more compressors 310. In aspects, in the system 100, when the natural gas cooler 200 produces one unit of cooled natural gas, three to five units of liquid nitrogen will automatically be produced in the nitrogen liquefier 300 in response to the amount of gaseous nitrogen that was produced in the one or more heat exchangers 210 in cooling that unit of liquid natural gas, assuming that amount of gaseous nitrogen is provided to the nitrogen liquefier 300.

In a first example aspect, the system 100 may be adapted to accommodate liquefying 5000 pounds per hour (lbs/hr) of natural gas, e.g., boil-off gas, where at steady state about 15,000 lbs/hr of liquid nitrogen or more would be produced in the nitrogen liquefier 300, with a suction pressure of the one or more compressors 310 at about 70-150 psia, or about 106 psia. In this first example aspect, the nitrogen liquefier 300 can have a flow rate of about 75,000 lbs/hr circulating therein, and a volumetric flow rate of about 40 cubic feet per second (ft/s). In this first example aspect, the system 100 can consume approximately 2000 kilowatts of power. It should be understood that this first example aspect is just one example capacity of the system 100 and that other sizes and/or capacities of the system 100 are also contemplated by the disclosure herein.

In a second example aspect, if the system 100 drops the rate of liquefying natural gas from 5000 lbs/hr to about 1500 lbs/hr, the one or more compressors 310 of the nitrogen liquefier 300 will spontaneously reduce the suction pressure to about 35 psia, e.g., from about 106 psia. In such aspects, at a compressor suction pressure of about 35 psia, 5000 lbs/hr of liquid nitrogen will be produced, with about 25,000 lbs/hr of gaseous nitrogen circulating in the nitrogen liquefier 300, at the same volumetric flow rate 40 $ft^3/s$ as that of the system 100 in the first example aspect above. Further in such aspects, since the volumetric flow rate stays the same, e.g., when the rate of liquefying or cooling natural gas changes in the natural gas cooler 200, the system efficiencies remain high. For instance, when the system 100 drops the rate of liquefying natural gas from 5000 lbs/hr to about 1500 lbs/hr, the system 100 consumes proportionately less power, e.g., by shifting from consuming approximately 2000 kW to approximately 700 kW. In aspects, this power savings from shifting the rate of liquefying natural gas from 5000 lbs/hr to about 1500 lbs/hr automatically reduces the rate of production of liquid nitrogen and also reduces the power consumption.

In certain aspects, in order to achieve the automatic change in production rate of the nitrogen liquefier 300 in response to a change in production rate of the natural gas cooler 200, the areas housing or utilizing liquid nitrogen in the natural gas cooler 200 may be isolated from the suction pressure of one or more compressors 310 in the nitrogen liquefier 300. For instance, in the aspect depicted in FIG. 1, the natural gas cooler 200 can include a valve 201 for isolating the pressure in the heat exchanger 210 from the pressure of nitrogen in the nitrogen liquefier 300. In aspects, the valve 201 can be any convenient pressure control valve or other type of valve that is capable of isolating the pressure in the heat exchanger 210 from the pressure of nitrogen in the nitrogen liquefier 300. In one aspect in operation, the valve 201 can maintain necessary pressure in the heat exchanger 210, as discuss further below, and whenever the heat exchanger 210 or associated conduits exposed to the nitrogen experience higher pressure, the valve 201 can allow more nitrogen, e.g., gaseous nitrogen, to flow out and to the nitrogen liquefier 300. Additional isolation mechanisms or designs are discussed further below with specific example natural gas cooler systems depicted in FIGS. 3-5.

Figure 3:
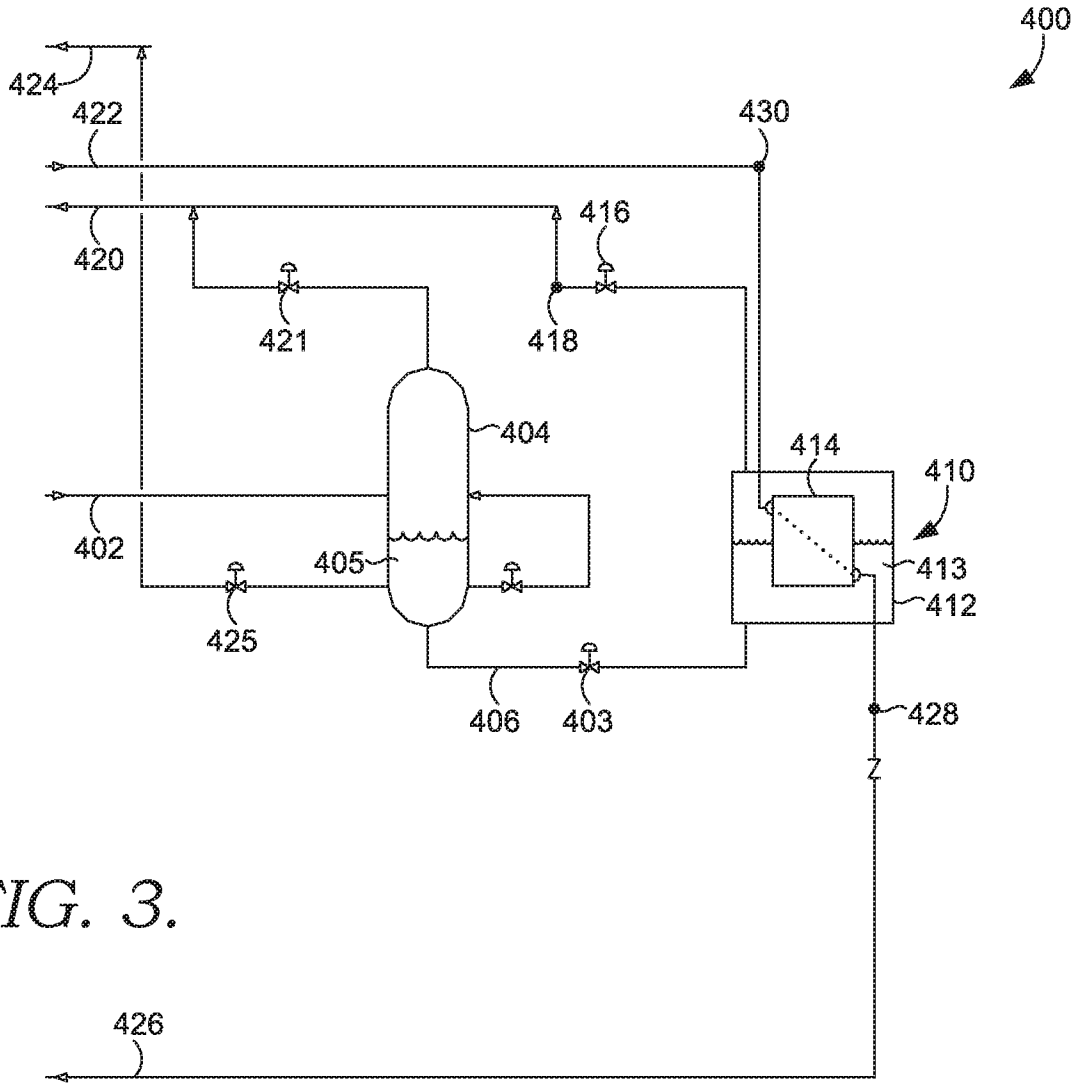
FIG. 3 depicts one example natural gas cooler, in accordance with aspects hereof.

Turning now to FIG. 3, an example natural gas cooler 400 is depicted. In aspects, at a high level, the natural gas cooler 400 depicted in FIG. 4 can cool a stream of natural gas in a heat exchanger, and also provide the boiled or gaseous nitrogen exiting the heat exchanger to a nitrogen liquefier, e.g., the nitrogen liquefier 300 described above with respect to FIGS. 1 and 2. In aspects, the stream of natural gas for cooling in the natural gas cooler 400 depicted in FIG. 3 can include a warm liquid natural gas, that is provided to a heat exchanger 410, via a warm liquid natural gas input conduit 422. In aspects, the warm liquid natural gas provided to the heat exchanger 410 can include any or all of the properties and parameters discussed above with reference to the one or more natural gas sources 202 of FIG. 1.

In certain aspects, the heat exchanger 410 can include a subcooler 414 positioned within a liquid nitrogen subcooler vessel 412, having a volume 413 of liquid nitrogen present therein. In aspects, the heat exchanger 410 can receive liquid nitrogen from a liquid nitrogen storage vessel 404 housing a storage volume 405 of liquid nitrogen, which is provided via a liquid nitrogen input conduit 402. In aspects, the liquid nitrogen input conduit 402 can be in fluid communication with the liquid nitrogen output conduit 302 of the nitrogen liquefier 300 discussed above with reference to FIGS. 1 and 2. In aspects, in addition to providing liquid nitrogen to the heat exchanger 410, the liquid nitrogen storage vessel 404 may provide one or more streams of nitrogen back to the nitrogen liquefier 300. For instance, the liquid nitrogen storage vessel 404 can provide a stream of cold gaseous nitrogen to the cold gaseous nitrogen output conduit 420 that may be in fluid communication with the cold gaseous nitrogen input conduit **306*b* of the nitrogen liquefier 300, and/or can provide a stream of warm gaseous nitrogen to the warm gaseous nitrogen output conduit 424 that may be in fluid communication with the warm gaseous nitrogen input conduit 306*a* of the nitrogen liquefier 300. In aspects, pressure control valves 421 and 425, which can control access to the cold gaseous nitrogen output conduit 420 and the warm gaseous nitrogen output conduit 424, respectively, may be utilized to at least partly isolate the pressure in the liquid nitrogen storage vessel 404**.

In aspects, the liquid nitrogen storage vessel 404 can maintain an internal pressure of between about 80 psia to about 150 psia, or about 120 psia. In the same or alternative aspects, the liquid nitrogen storage vessel 404 can maintain the volume 405 of liquid nitrogen at a temperature of about −240° F. to about −290° F., or about −270° F. to about −285° F., or about −278° F.

In certain aspects, the liquid nitrogen storage vessel 404 can provide a stream of liquid nitrogen to the liquid nitrogen subcooler vessel 412 via a conduit 406. In the same or alternative aspects, a stream of gaseous nitrogen may exit the heat exchanger 410 via the cold gaseous nitrogen output conduit 420. In such aspects, the gaseous nitrogen exiting the heat exchanger 410, at a point 418 along the cold gaseous nitrogen output conduit 420 can exhibit a temperature of about −242° F. to about −292° F., or about −272° F. to about −282° F., or about −280° F. In the same or alternative aspects, the gaseous nitrogen exiting the heat exchanger 410, at a point 418 along the cold gaseous nitrogen output conduit 420, can be at a pressure of between about 80 psia to about 150 psia, or about 110 psia.

In certain aspects, the liquid nitrogen subcooler vessel 412 can maintain an internal pressure of between about 80 psia to about 150 psia, or about 115 psia. In the same or alternative aspects, the liquid nitrogen subcooler vessel 412 can maintain the volume 413 of liquid nitrogen at a temperature of about −240° F. to about −290° F., or about −270° F. to about −285° F., or about −279° F.

In aspects, valves 403 and 416 in the conduit 406 and the cold gaseous nitrogen output conduit 420, respectively, can be utilized to isolate the pressure of the nitrogen in the liquid nitrogen subcooler vessel 412 and/or the heat exchanger 410 from the suction compressor pressure in the nitrogen liquefier 300, in order to facilitate the automatic adjustment of the nitrogen liquefier production rate based on the production rate of the natural gas cooler 400.

In aspects, the heat exchanger 410 can reduce a temperature of a stream of natural gas, e.g., via the warm liquid natural gas input conduit 422, by about 1-20° F., or by about 5-15° F., or by about 8-12° F., or about 10° F. In aspects, warm liquid natural gas can enter the natural gas cooler 400 from the warm liquid natural gas input conduit 422, and at a point 430 along the warm liquid natural gas input conduit 422 exhibit a temperature of between about −240° F. and about −280° F., or between about −250° F. and about −275 CF, or about −265° F. In the same or alternative aspects, the liquid natural gas exiting the heat exchanger 410 can exhibit a temperature at a point 428 along the cool liquid natural gas output conduit 426 of between about −250 CF and about −290 CF, or between about −260° F. and about −285 CF, or about −275 CF.

Figure 4:
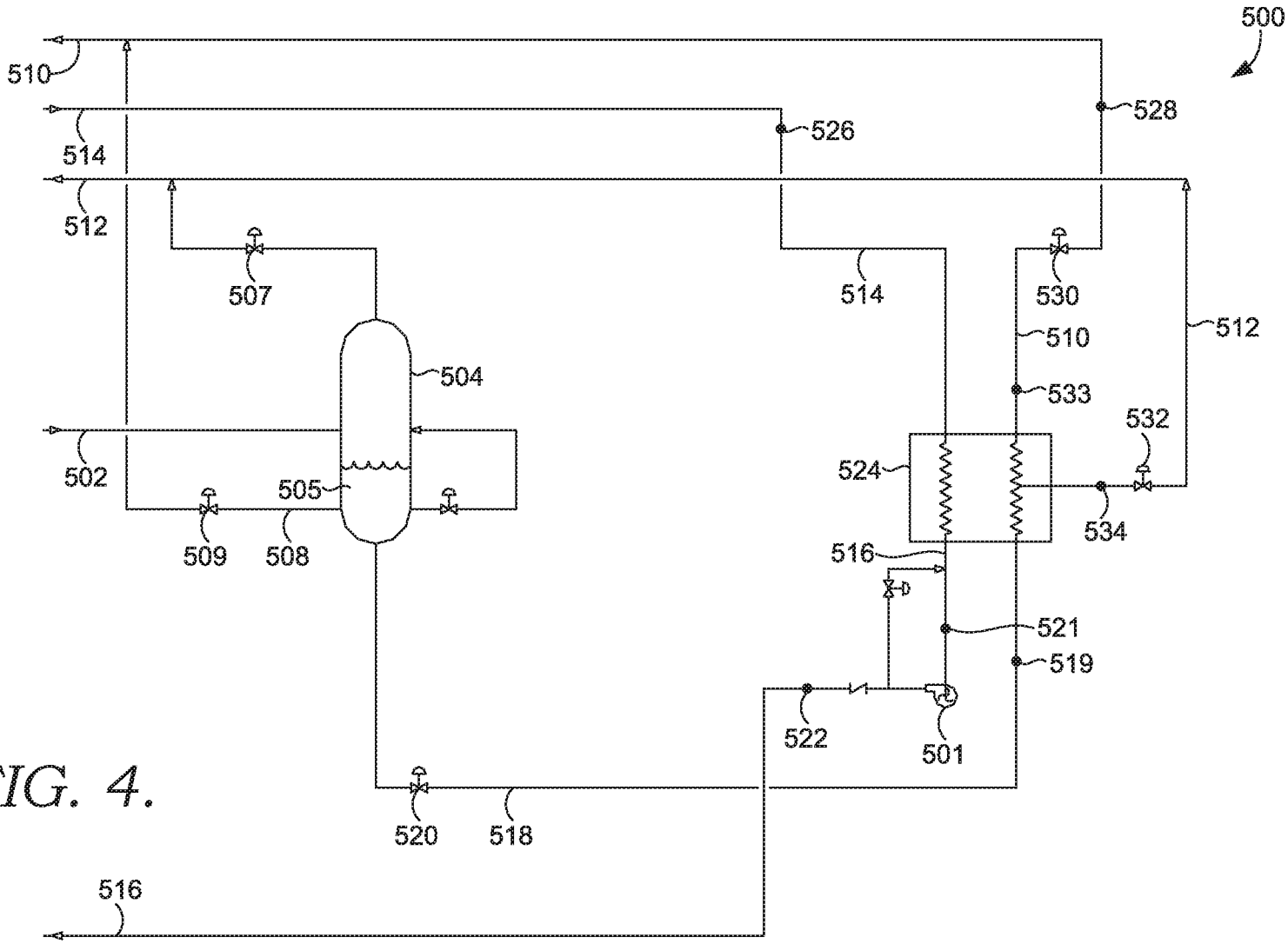
FIG. 4 depicts another example natural gas cooler, in accordance with aspects hereof.

FIG. 4 depicts another example natural gas cooler 500. The natural gas cooler 500 can cool one or more streams of natural gas in a heat exchanger, and also provide the boiled or gaseous nitrogen exiting the heat exchanger to a nitrogen liquefier, e.g., the nitrogen liquefier 300 described above with respect to FIGS. 1 and 2. In aspects, the stream of natural gas for cooling in the natural gas cooler 500 depicted in FIG. 4 can include boil-off gas, which can be provided to a heat exchanger 524, via a boil-off gas input conduit 514.

In aspects, the boil-off gas provided to the heat exchanger 524 can include any or all of the properties and parameters discussed above with reference to the one or more natural gas sources 202 of FIG. 1. In one aspect, the boil-off gas provided to the heat exchanger 524 can be low nitrogen content boil-off gas, e.g., having about 10 mol. % or less of nitrogen. In certain aspects, the boil-off gas can exhibit a temperature between about −70 CF and about −150 CF, or between about −80° F. and about −140° F., or about −100° F., at a point 526 along the boil-off gas input conduit 514. In the same or alternative aspects, the boil-off gas can be present at a pressure of between about 15 psia and about 120 psia, or between about 25 psia and about 100 psia, or about 45 psia, at the point 526 along the boil-off gas input conduit 514. Alternatively, the boil-off gas can exhibit a temperature between about 60° F. and about 100° F.

In order to cool or re-condense the boil-off gas, the heat exchanger 524 may receive liquid nitrogen from a liquid nitrogen storage vessel 504 housing a volume 505 of liquid nitrogen, via a conduit 518. In aspects, the liquid nitrogen storage vessel 504 can include any or all of the properties and parameters discussed above with respect to the liquid nitrogen storage vessel 404 and associated input conduits, output conduits, and pressure isolating valves discussed above with respect to FIG. 3. For instance, in aspects, liquid nitrogen can be provided to the liquid nitrogen storage vessel 504 via a liquid nitrogen input conduit 502, which can be in fluid communication with the liquid nitrogen output conduit 302 of the nitrogen liquefier 300 discussed above with reference to FIGS. 1 and 2. In aspects, in addition to providing liquid nitrogen to the heat exchanger 524, the liquid nitrogen storage vessel 504 may provide one or more streams of nitrogen back to the nitrogen liquefier 300. For instance, the liquid nitrogen storage vessel 504 can provide a stream of cold gaseous nitrogen to the cold gaseous nitrogen output conduit 512 that may be in fluid communication with the cold gaseous nitrogen input conduit **306*b* of the nitrogen liquefier 300, and/or can provide a stream of warm gaseous nitrogen to the warm gaseous nitrogen output conduit 510 that may be in fluid communication with the warm gaseous nitrogen input conduit 306*a* of the nitrogen liquefier 300. In aspects, pressure control valves 507 and 509, which can control access to the cold gaseous nitrogen output conduit 512 and the warm gaseous nitrogen conduit 510, respectively, may be utilized to at least partly isolate the pressure in the liquid nitrogen storage vessel 504**.

In aspects, the liquid nitrogen storage vessel 504 can maintain an internal pressure of between about 80 psia and about 150 psia, or about 120 psia. In the same or alternative aspects, the liquid nitrogen storage vessel 504 can maintain the volume 505 of liquid nitrogen at a temperature of between about −240° F. and about −290° F., or between about −270° F. and about −285° F., or about −278° F.

In certain aspects, the liquid nitrogen storage vessel 504 can provide a stream of liquid nitrogen to the heat exchanger 524 via a conduit 518. Prior to entering the heat exchanger 524 at a point 519 along the conduit 518, the liquid nitrogen can be at a temperature of between about −240° F. and about −290° F., or between about −270° F. and about −285° F., or about −279° F., and/or at a pressure of between about 80 psia and about 150 psia, or about 115 psia. In certain aspects, a portion of the liquid nitrogen, e.g., nitrogen vapor, entering the heat exchanger 524 from the conduit 518 may exit the heat exchanger 524 via the cold gaseous nitrogen output conduit 512, where at a point 534 along the cold gaseous nitrogen output conduit 512, the temperature and/or pressure can be within the same parameters as the nitrogen at the point 519 in the conduit 518. In such aspects, this stream of cold gaseous nitrogen exiting the natural gas cooler 500 along with the cold gaseous nitrogen output conduit 512 can be provided to nitrogen liquefier 300 via the cold gaseous nitrogen input conduit **306*b***.

In aspects, a portion of the nitrogen may exit the heat exchanger 524 via the warm gaseous nitrogen output conduit 510, where at a point 533 along this conduit, the nitrogen can exhibit a temperature of between about 0 T and about −120° F., between about −15° F. and about −80° F., or about −45° F. and/or exhibit a pressure of between about 80 psia and about 150 psia, or about 115 psia.

In aspects, valves 530, 532, and 520, in the warm gaseous nitrogen output conduit 510, the cold gaseous nitrogen output conduit 512, and the conduit 518, respectively, can be utilized to isolate the pressure of the nitrogen in the heat exchanger 524 from the suction compressor pressure in the nitrogen liquefier 300, in order to facilitate the automatic adjustment of the nitrogen liquefier production rate based on the production rate of the natural gas cooler 500.

In aspects, at a point 528 along the warm gaseous nitrogen output conduit 510 downstream of the valve 530, the nitrogen can exhibit a temperature of between about −50° F. and about −200° F., between about −70° F. and about −150° F., or about −95° F. and/or exhibit a pressure of between about 80 psia and about 150 psia, or about 110 psia, where the nitrogen can be returned to the nitrogen liquefier 300, e.g., via the warm gaseous nitrogen input conduit **306*a* of the nitrogen liquefier 300 of FIG. 2. Alternatively, the nitrogen at the point 528 (and/or at the point 533**) can exhibit a temperature between about 60° F. and about 100° F.

In aspects, the heat exchanger 524 can reduce a temperature of a stream of natural gas, e.g., via boil-off gas input conduit 514, by about 50-200° F., or by about 80-190° F., or by about 165° F. In aspects, the liquid natural gas exiting the heat exchanger 524 can exhibit a temperature at a point 521 along the cool liquid natural gas output conduit 516 of between about −250° F. and about −290° F., or between about −250° F. and about −285° F., or about −265° F., and/or can be present at a pressure of between about 15 psia and about 120 psia, or between about 25 psia and about 100 psia, or about 40 psia. In various aspects, a pump 501 may be utilized to increase the pressure of the liquid natural gas in the cool liquid natural gas output conduit 516 at the point 522 along the conduit 516 to a pressure of between about 30 psia and about 160 psia, or between about 50 psia and about 130 psia, or about 80 psia, with the temperature being relatively maintained to that at the point 521. The cool liquid natural gas may exit the natural gas cooler 500 for any desired downstream use.

Figure 5:
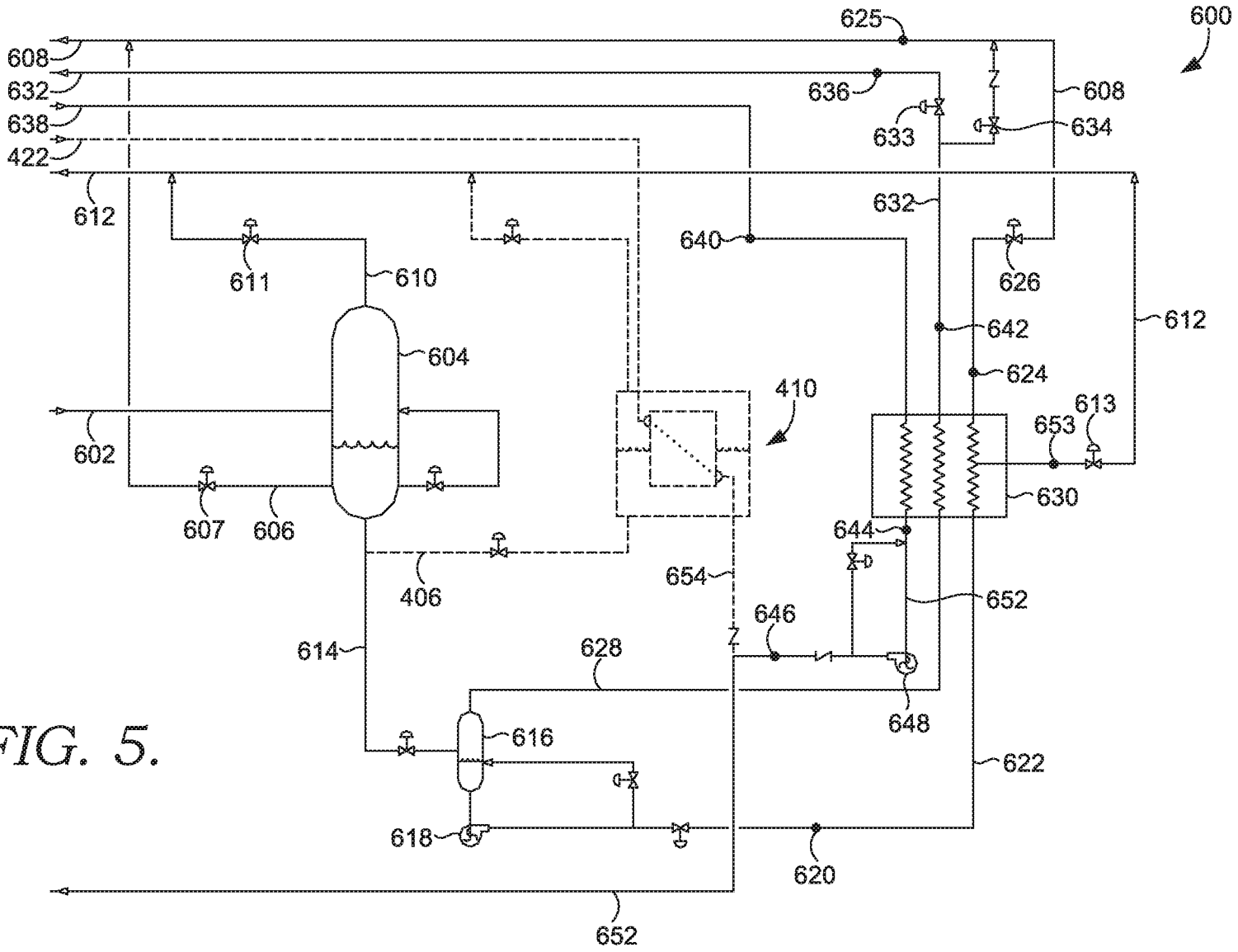
FIG. 5 depicts another example natural gas cooler, in accordance with aspects hereof.

FIG. 5 depicts another example natural gas cooler 600. The natural gas cooler 600 can cool one or more streams of natural gas in a heat exchanger, and also provide the boiled or gaseous nitrogen exiting the heat exchanger to a nitrogen liquefier, e.g., the nitrogen liquefier 300 described above with respect to FIGS. 1 and 2. In aspects, at least one stream of natural gas for cooling in the natural gas cooler 600 depicted in FIG. 5 can include boil-off gas, that is provided to a heat exchanger 630, via a boil-off gas input conduit 638.

In aspects, the boil-off gas provided to the heat exchanger 630 can include any or all of the properties and parameters discussed above with reference to the one or more natural gas sources 202 of FIG. 1. In one aspect, the boil-off gas provided to the heat exchanger can be a high nitrogen content boil-off gas, e.g., having about 10 mol. % or more of nitrogen. In certain aspects, the boil-off gas can exhibit a temperature between about −150° F. and about −280° F., or between about −180° F. and about −260° F., or about −220° F., at a point 640 along the boil-off gas input conduit 638. In the same or alternative aspects, the boil-off gas can be present at a pressure of between about 1 psia and about 50 psia, or between about 3 psia and about 30 psia, or about 15 psia, at the point 640 along the boil-off gas input conduit 638. Alternatively, the boil-off gas can exhibit a temperature of between about 60° F. to about 100° F.

In order to cool or re-condense the boil-off gas, the heat exchanger 630 may ultimately receive liquid nitrogen from a liquid nitrogen storage vessel 604. In aspects, the liquid nitrogen storage vessel 604 can include any or all of the properties and parameters discussed above with respect to the liquid nitrogen storage vessel 404 and associated input conduits, output conduits, and pressure isolating valves discussed above with respect to FIG. 3. For instance, in aspects, liquid nitrogen can be provided to the liquid nitrogen storage vessel 604 via a liquid nitrogen input conduit 602, which can be in fluid communication with the liquid nitrogen output conduit 302 of the nitrogen liquefier 300 discussed above with reference to FIGS. 1 and 2. In aspects, in addition to ultimately providing liquid nitrogen at least to the heat exchanger 630, the liquid nitrogen storage vessel 604 may provide one or more streams of nitrogen back to the nitrogen liquefier 300. For instance, the liquid nitrogen storage vessel 604 can provide a stream of cold gaseous nitrogen to the cold gaseous nitrogen output conduit 612 via a conduit 610, and/or can provide a stream of warm gaseous nitrogen to the warm gaseous nitrogen output conduit 608 via a conduit 606. In aspects, pressure control valves 611 and 607, which can control access to the cold gaseous nitrogen output conduit 612 and the warm gaseous nitrogen conduit 608, respectively, may be utilized to at least partly isolate the pressure in the liquid nitrogen storage vessel 604.

In aspects, the liquid nitrogen storage vessel 604 can maintain an internal pressure of between about 80 psia and about 150 psia, or about 120 psia. In the same or alternative aspects, the liquid nitrogen storage vessel 504 can maintain the volume 505 of liquid nitrogen at a temperature of between about −240° F. and about −290° F., or between about −270° F. and about −285° F., or about −278° F.

In certain aspects, where the boil-off gas comprises a high nitrogen content boil-off gas, e.g., having about 10 mol. % or more of nitrogen, the liquid nitrogen may need to be colder than the temperature of the liquid nitrogen in the liquid nitrogen storage vessel 604. In such aspects, the natural gas cooler 600 can include a second liquid nitrogen storage vessel 616 that houses liquid nitrogen at a reduced pressure to aid in achieving this reduced temperature. The second liquid nitrogen storage vessel 616, in aspects, can be supplied with liquid nitrogen from the liquid nitrogen storage vessel 604 via the conduit 614.

In aspects, the second liquid nitrogen storage vessel 616 can maintain an internal pressure of between about 15 psia and about 90 psia, or about 60 psia. In the same or alternative aspects, the second liquid nitrogen storage vessel 616 can maintain the liquid nitrogen at a temperature of between about −260° F. and about −315° F., or between about −270° F. and about −310° F., or about −295° F.

In certain aspects, a portion of the liquid nitrogen in the second liquid nitrogen storage vessel 616 can be provided to the heat exchanger 630 via the conduit 628, wherein upon exiting the heat exchanger 630 the nitrogen in the conduit 632 at the point 642 can exhibit a temperature of between about −170° F. and about −250 F, or between about −180° F. and about −230° F., and/or be present at a pressure of between about 15 psia and about 90 psia, or about 60 psia. In aspects, downstream of the point 642 in the conduit 632 the nitrogen may be exposed to a heater, which may increase the temperature of the nitrogen downstream of such a heater to a temperature of between about −20° F. and about 90 F, or about 60° F. In such aspects, at least a portion of the nitrogen can then exit the natural gas cooler 600 via the conduit 632 at a pressure of between 0 psia and about 30 psia, or about 10 psia at point 636, where it may ultimately be provided to the nitrogen recovery compressor conduit **306*c* of the nitrogen liquefier 300 of FIG. 3. In the same or alternate aspects, at least a portion of the nitrogen may exit the natural gas cooler 600 via the warm gaseous nitrogen output conduit 608. In aspects, at the point 625 along the warm gaseous nitrogen output conduit 608 the nitrogen may be present at a pressure of between about 50 psia and about 160 psia, or about 110 psia. In aspects, the nitrogen exiting the natural gas cooler 600 via the warm gaseous nitrogen output conduit 608 may be provided to the nitrogen liquefier 300 of FIG. 3 via the fluid coupling of the warm gaseous nitrogen output conduit 608 of the natural gas cooler 600 with the warm gaseous nitrogen input conduit 306*a* of the nitrogen liquefier 300**.

In certain aspects, another portion of liquid nitrogen from the second liquid nitrogen storage vessel 616 may be provided to the heat exchanger 630 via the conduit 622. In such aspects a pump 618 may be utilized to increase the pressure of the liquid nitrogen being provided to the heat exchanger 630 via the conduit 622, where at a point 620 along the conduit 622 the liquid nitrogen is present at a pressure of between about 70 psia and about 160 psia, or about 115 psia, and/or at a temperature of between about −260° F. and about −315° F., or between about −270° F. and about −310° F., or about −295° F. In certain aspects, a portion of the liquid nitrogen, e.g., nitrogen vapor, entering the heat exchanger 630 from the conduit 622 may exit the heat exchanger 630 via the cold gaseous nitrogen output conduit 612. In such aspects, the temperature of the nitrogen at the point 653 in the cold gaseous nitrogen output conduit 612 can be between about −240° F. and about −310° F., or about −280° F. In the same or alternate aspects, the nitrogen at the point 653 in the cold gaseous nitrogen output conduit 612 can present at a pressure of between about 80 psia and about 150 psia, or about 115 psia.

In aspects, a portion of the nitrogen entering the heat exchanger 630 from the conduit 622 may exit the heat exchanger 630 via the warm gaseous nitrogen output conduit 608, where at a point 624 along this conduit, the nitrogen can exhibit a temperature of between about −180° F. and about −240° F., or about −215° F. and/or exhibit a pressure of between about 80 psia and about 150 psia, or about 115 psia. Alternatively, the nitrogen at the point 624 (and/or at the point 625) can exhibit a temperature between about 60° F. and about 100° F.

In aspects, valves 613, 626, 633, and 634 can be utilized to at least partly isolate the pressure of the nitrogen in the heat exchanger 630 from the suction compressor pressure in the nitrogen liquefier 300, in order to facilitate the automatic adjustment of the nitrogen liquefier production rate based on a the production rate of the natural gas cooler 600.

In aspects, the heat exchanger 630 can reduce a temperature of a stream of natural gas, e.g., via boil-off gas input conduit 638, by about 30-90° F., or by about 60° F., exiting the heat exchanger 630 at a point 644 along the conduit 652. In the same or alternative aspects, at the point 644 along the conduit 652 the natural gas can be present at a pressure of between about 1 psia and about 50 psia, or between about 3 psia and about 30 psia, or about 15 psia, and/or the nitrogen can exhibit a temperature of between about −240° F. and about −310° F., or about −297° F. In various aspects, the exiting cooled natural gas may be exposed to a pump 648, where the pressure of the natural gas is increased, e.g., to between about 15 psia and about 80 psia, or about 50 psia, at a point 646 along the conduit 652. The cooled natural gas exiting the natural gas cooler 600 via the conduit 652 can be utilized in any desired downstream purpose.

In certain aspects, one or more components of the natural gas cooler 400 depicted in FIG. 3 can be also present along with the other components of the natural gas cooler 500 and/or natural gas cooler 600 depicted in FIGS. 4 and 5, respectively. For instance, FIG. 5 depicts how the heat exchanger 410 of the natural gas cooler 400 of FIG. 3 can optionally be incorporated into the natural gas cooler 600. As can be seen in FIG. 5, the heat exchanger 410 can receive liquid nitrogen from the liquid nitrogen storage vessel 604 via the conduit 406, and can exit the heat exchanger 410 via the cold gaseous nitrogen output conduit 612. Further in such aspects, warm liquid natural gas can be provided to the heat exchanger 410 via the warm liquid natural gas conduit 422 and may be cooled in the heat exchanger 410 and exit via the conduit 654, which can then proceed to the conduit 652 for exiting the natural gas cooler 600.

As discussed above, it should be understood that the example natural gas coolers 400, 500, and 600 depicted in FIGS. 3-5, respectively, are just a few example natural gas coolers contemplated by the present disclosure. Further, the flow rates, temperatures, pressures, and circulation volumes are also just examples and not intended to be limiting on the concepts and disclosure provided herein, but are rather intended to illustrate various example systems.

Figure 6:
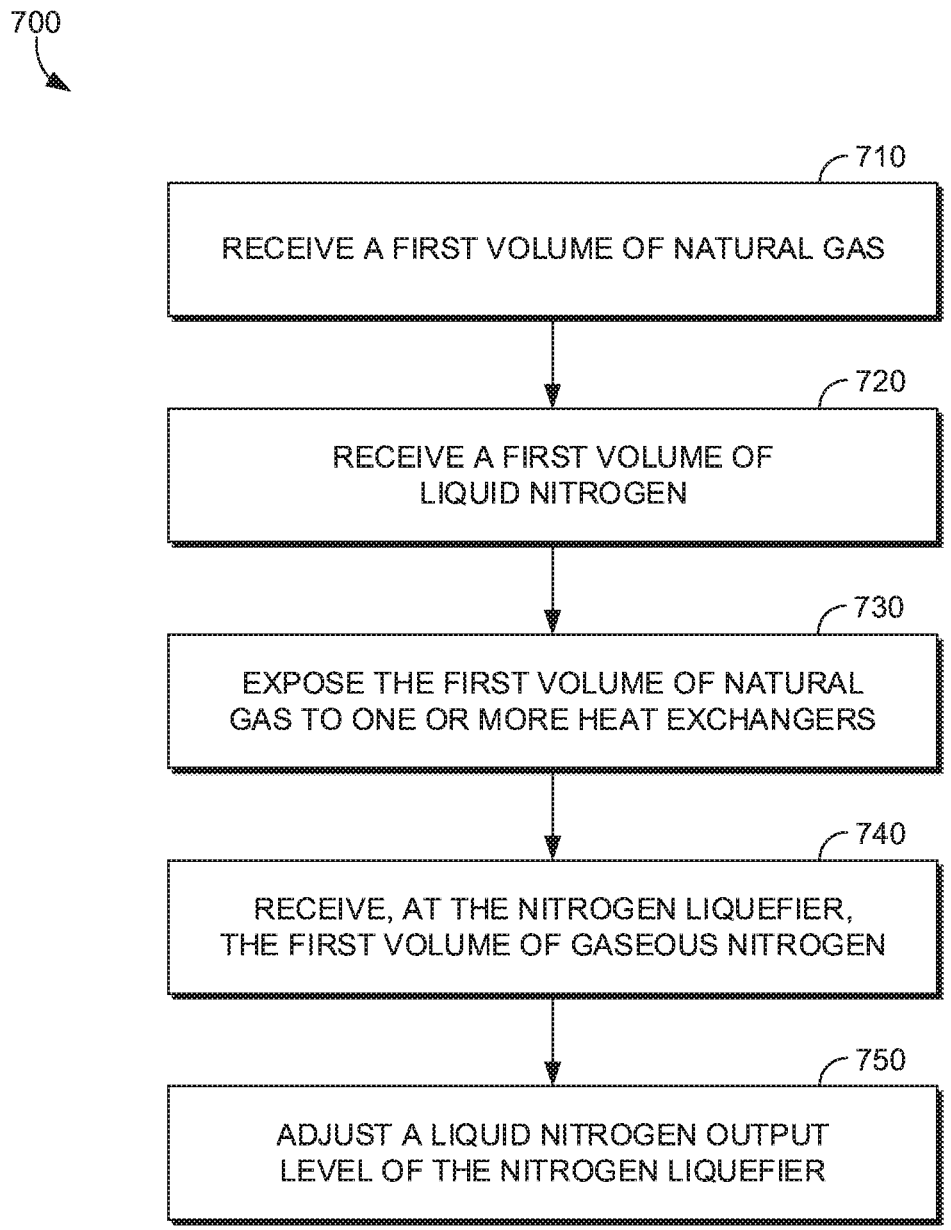
FIG. 6 is a flow diagram schematically representing a method for cooling natural gas, in accordance with aspects hereof.

FIG. 6 depicts a schematic flow diagram of one example method 700 for cooling natural gas using nitrogen. The method 700 can include the step 710 of receiving a first volume of natural gas. In aspects, the natural gas can include any or all of the properties and parameters discussed above with respect to the one or more natural gas sources 202 of FIG. 1. In certain aspects, the natural gas can be received via one or more of the boil-off gas input conduits and/or the warm liquid natural gas input conduits discussed above with respect to the natural gas coolers 400, 500, and 600 of FIGS. 3-5, respectively.

The method 700 can also include a step 720 of receiving a first volume of liquid nitrogen. In aspects, the first volume of liquid nitrogen can be provided from a nitrogen liquefier, such as the nitrogen liquefier 300 discussed above with respect to FIGS. 1 and 2.

The method 700 can include a step 730 of exposing the first volume of natural gas to one or more heat exchangers. In aspects in the step 730, the one or more heat exchangers can include at least part of the first volume of liquid nitrogen, and where upon exposure of the natural gas to the one or more heat exchangers a temperature of the first volume of natural gas can be reduced. In the same or alternate aspects, at least part of the liquid nitrogen present in the one or more heat exchangers can form a volume of gaseous nitrogen. Further in aspects, the one or more heat exchangers can be in fluid communication with the nitrogen liquefier to provide the gaseous nitrogen to the nitrogen liquefier, where at the step 740 of the method 700, the gaseous nitrogen is received at the nitrogen liquefier. In aspects, the fluid communication between the one or more heat exchangers and the nitrogen liquefier can be accomplished using the system 100 discussed above with respect to FIG. 1 and/or the natural gas coolers 400, 500, and 600 discussed above with respect to FIGS. 3-5, respectively.

The method 700 can also include the step 750, where in response to receiving the gaseous nitrogen at the nitrogen liquefier from the one or more heat exchangers, a nitrogen output level or production level of the nitrogen liquefier is adjusted. In aspects, the nitrogen output level or production level of the nitrogen liquefier is automatically adjusted due to a change in pressure within the nitrogen liquefier in response to receiving the gaseous nitrogen from the one or more heat exchangers, as discussed above with respect to the system 100 of FIG. 1.

From the foregoing, it will be seen that this disclosure is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

While specific elements and steps are discussed in connection to one another, it is understood that any element and/or steps provided herein is contemplated as being combinable with any other elements and/or steps regardless of explicit provision of the same while still being within the scope provided herein. Since many possible embodiments may be made of the disclosure without departing from the scope thereof, it is to be understood that all matter herein set forth or shown in the accompanying drawings is to be interpreted as illustrative and not in a limiting sense.

What is claimed is:

1. A system for natural gas cooling using nitrogen, the system comprising:

a nitrogen liquefier, the nitrogen liquefier comprising:

one or more gaseous nitrogen input conduits in fluid communication with one or more gaseous nitrogen sources;

one or more liquid nitrogen output conduits; and one or more compressors in fluid communication with the one or more gaseous nitrogen input conduits, wherein the nitrogen liquefier is adapted to convert gaseous nitrogen supplied by the one or more gaseous nitrogen sources into liquid nitrogen that is provided to the one or more liquid nitrogen output conduits;

a natural gas cooler, the natural gas cooler comprising:

one or more natural gas input conduits in fluid communication with one or more natural gas sources;

one or more cooled liquid natural gas output conduits; and one or more heat exchangers in fluid communication with: i) the one or more gaseous nitrogen input conduits of the nitrogen liquefier; and ii) the one or more cooled liquid natural gas output conduits, wherein the natural gas cooler is adapted to reduce a temperature of natural gas from the one or more natural gas sources forming a cooled liquid natural gas that is provided to the one or more cooled liquid natural gas output conduits;

wherein the natural gas cooler has a first pressure and the nitrogen liquefier has a second pressure and the first pressure;

wherein the system comprises a valve located on a conduit to maintain that the first pressure and the second pressure are isolated; and wherein the system is configured such that, in response to a change in a production rate of cooled liquid natural gas being produced in the one or more heat exchangers, a production rate of liquid nitrogen produced in the nitrogen liquefier is changed.

2. The system according to claim 1, wherein the natural gas cooler further comprises a first liquid nitrogen storage vessel in fluid communication with the one or more liquid nitrogen output conduits, wherein a first volume of liquid nitrogen is present in the first liquid nitrogen storage vessel, and wherein the first liquid nitrogen storage vessel is maintained at an internal pressure between 80 psia and 160 psia.

3. The system according to claim 2, wherein the first liquid nitrogen storage vessel is in fluid communication with the one or more heat exchangers.

4. The system according to claim 3, wherein the one or more heat exchangers comprises a first heat exchanger, wherein the first heat exchanger comprises a subcooler vessel and one or more subcooler conduits extending through the subcooler vessel, wherein the subcooler vessel is adapted to house a portion of the liquid nitrogen from the first liquid nitrogen storage vessel, and wherein the one or more subcooler conduits is in fluid communication with the one or more natural gas input conduits.

5. The system according to claim 4, wherein the first heat exchanger is adapted to reduce a temperature of natural gas from the one or more natural gas sources by about 1-20° F.

6. The system according to claim 1, wherein the natural gas cooler further comprises a first liquid nitrogen storage vessel in fluid communication with the one or more liquid nitrogen output conduits, wherein a first volume of liquid nitrogen is present in the first liquid nitrogen storage vessel, wherein the first liquid nitrogen storage vessel is maintained at an internal pressure between 80 psia and 160 psia, wherein the natural gas cooler further comprises a second liquid nitrogen storage vessel in fluid communication with the first liquid nitrogen storage vessel, and wherein the second liquid nitrogen storage vessel is maintained at an internal pressure between 15 psia and 90 psia.

7. The system according to claim 6, further comprising a second heat exchanger, wherein the second heat exchanger is in fluid communication with the second liquid nitrogen storage vessel.

8. The system according to claim 7, wherein the second heat exchanger is adapted to convert a volume of gaseous natural gas from the one or more natural gas sources to a volume of the cooled liquid natural gas.

9. The system according to claim 1, wherein the one or more natural gas sources comprises warm liquid natural gas, boil-off gas, or a combination thereof, and wherein the warm liquid natural gas exhibits a temperature in the range of about −255° F. to about −270° F.

10. The system according to claim 1, wherein the one or more natural gas sources comprises: i) methane in an amount of about 51% to about 95%; and ii) optionally, nitrogen in an amount of about 0.1% to about 12%.

11. The system according to claim 1, wherein the one or more natural gas sources comprises: i) methane in an amount of about 51% to about 95%; and ii) nitrogen in an amount of about 5% to about 30%.

* * * * *